US010364810B2

(12) United States Patent
Nagura et al.

(10) Patent No.: US 10,364,810 B2
(45) Date of Patent: Jul. 30, 2019

(54) RECIPROCATING COMPRESSOR, COMPRESSION SECTION UNIT, AND MAINTENANCE METHOD OF RECIPROCATING COMPRESSOR

(71) Applicant: Kobe Steel, Ltd., Kobe-shi (JP)

(72) Inventors: Kenji Nagura, Takasago (JP); Katsuhiro Seyama, Takasago (JP); Satoshi Tezuka, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 486 days.

(21) Appl. No.: 14/963,473

(22) Filed: Dec. 9, 2015

(65) Prior Publication Data

US 2016/0245274 A1 Aug. 25, 2016

(30) Foreign Application Priority Data

Feb. 20, 2015 (JP) ..... 2015-032306

(51) Int. Cl.
*F04B 39/14* (2006.01)
*F04B 49/10* (2006.01)
(Continued)

(52) U.S. Cl.
CPC ..... *F04B 49/10* (2013.01); *F04B 35/045* (2013.01); *F04B 39/0022* (2013.01);
(Continued)

(58) Field of Classification Search
CPC ..... F04B 39/14; F04B 39/121
See application file for complete search history.

(56) References Cited

U.S. PATENT DOCUMENTS 4,773,833 A * 9/1988 Wilkinson ..... B01F 15/0201 137/327
2009/0123303 A1* 5/2009 Ohnishi ..... F04B 39/14 417/270
(Continued)

FOREIGN PATENT DOCUMENTS

CN 104121169 A 10/2014
EP 0 833 054 A2 4/1998
(Continued)

OTHER PUBLICATIONS

Extended European Search Report dated Jun. 28, 2016 in Patent Application No. 15197972.1.

*Primary Examiner* — F Daniel Lopez
(74) *Attorney, Agent, or Firm* — Oblon, McClelland, Maier & Neustadt, L.L.P.

(57) ABSTRACT

A reciprocating compressor is provided with a compression section which compresses gas, and a crank section which has a crankshaft and drives the compression section. The compression section is provided with a wall body portion which includes a cylinder and constitutes a wall body of the compression section, a cylinder head attached to the cylinder, a piston which reciprocates within the cylinder, a piston rod which couples the crankshaft and the piston, and at least one sealing member fixed to the wall body portion and disposed in the circumference of the piston rod. The wall body portion has a first boundary wall which forms the boundary with the crank section in the crank section side with respect to the at least one sealing member and acts as a division surface when the crank section and the compression section are separated.

14 Claims, 8 Drawing Sheets

(51) Int. Cl.

| | |
|---|---|
| ***F04B 35/04*** | (2006.01) |
| ***F04B 39/12*** | (2006.01) |
| ***F04B 53/16*** | (2006.01) |
| ***F04B 39/00*** | (2006.01) |
| ***F17C 9/02*** | (2006.01) |

(52) U.S. Cl.

CPC ..... *F04B 39/0094* (2013.01); *F04B 39/12* (2013.01); *F04B 39/121* (2013.01); *F04B 39/125* (2013.01); *F04B 39/14* (2013.01); *F04B 53/164* (2013.01); *F17C 9/02* (2013.01)

(56) References Cited

U.S. PATENT DOCUMENTS

| | | | |
|---|---|---|---|
| 2011/0103976 | A1 | 5/2011 | Fejzuli |
| 2014/0322043 | A1 | 10/2014 | Nagura et al. |
| 2014/0369858 | A1 | 12/2014 | Fejzuli |

FOREIGN PATENT DOCUMENTS

| | | | |
|---|---|---|---|
| EP | 2 796 715 | A2 | 10/2014 |
| EP | 2 796 715 | A3 | 10/2014 |
| JP | 10-103245 | A | 4/1998 |
| JP | 11-62831 | A | 3/1999 |
| JP | 2011-517749 | | 6/2011 |
| KR | 10-2004-0102913 | A | 12/2004 |
| KR | 10-2014-0128246 | A | 11/2014 |

* cited by examiner

RECIPROCATING COMPRESSOR, COMPRESSION SECTION UNIT, AND MAINTENANCE METHOD OF RECIPROCATING COMPRESSOR

BACKGROUND OF THE INVENTION

Field of the Invention

The present invention relates to a reciprocating compressor, a compression section unit, and a maintenance method of the reciprocating compressor.

Description of the Related Art

Recently, in ships loaded with a storage tank of a liquefied natural gas, a technique of compressing and supplying a boil-off gas generated within the storage tank to the engine of the ship is proposed. Moreover, in order to supply the boil-off gas to the engine, a large-scale reciprocating compressor is used.

In a reciprocating compressor described in Japanese Translation of PCT International Application Publication No. JP-T-2011-517749 as one such example, a crank drive mechanism provided with a crankshaft, a push rod (commonly referred to as a connecting rod), and the like is disposed on the lower side, and in the upper part thereof, a compression stage provided with a cylinder, a cylinder head, a piston, a piston rod coupled to the push rod, and the like is disposed. Moreover, as for the reciprocating compressor described in Japanese Translation of PCT International Application Publication No. JP-T-2011-517749, a plurality of the reciprocating compressors are arranged side by side in a common housing, and the crank drive mechanisms are fixed to the common housing.

In such a reciprocating compressor, it is preferable to regularly perform a maintenance work for replacing components such as a piston and a cylinder in which severe wear occurs. However, in the maintenance of the reciprocating compressor disclosed in Japanese Translation of PCT International Application Publication No. JP-T-20111-517749, it is necessary to remove the upper part of the cylinder of the compression stage and pull the piston out of the cylinder upwardly. In this manner, a removal work of members inside the reciprocating compressor is performed on a large scale.

Moreover, when accommodating a new piston into the cylinder, it is necessary to insert the piston and the piston rod to which the piston is attached from the upper part of the cylinder. At this time, the piston rod is likely to come in contact with a sealing member held by the cylinder or the like.

The present invention has a main object of easily performing maintenance of a compression section of a reciprocating processor.

A reciprocating compressor which solves the above problem is provided with a compression section which compresses gas, and a crank section which has a crankshaft and drives the compression section. The compression section is provided with a wall body portion which includes a cylinder and constitutes a wall body of the compression section, a cylinder head attached to the cylinder, a piston which reciprocates within the cylinder, a piston rod which couples the crankshaft and the piston, and at least one sealing member fixed to the wall body portion and disposed in the circumference of the piston rod. The wall body portion has a boundary portion which forms the boundary with the crank section in the crank section side with respect to the at least one sealing member and acts as a division surface when the crank section and the compression section are separated.

According to the reciprocating compressor, compared to the case where the sealing member is located on the crank section side with respect to the division surface between the compression section and the crank section, the piston rod is prevented from interfering with the sealing member at the time of separation or bonding of the compression section and the crank section. Therefore, maintenance of the compression section of the reciprocating compressor can be easily performed.

In the reciprocating compressor which solves the above problem, the compression section is provided with an attachment portion for mounting a stopper member which restricts the movement in the reciprocating direction of the piston within the cylinder so that the piston does not come in contact with the cylinder head in case of being separated from the crank section.

According to the reciprocating compressor, by attaching the stopper member to the attachment portion before separating the compression section and the crank section, the movement in the reciprocating direction of the piston within the cylinder in the case where the compression section and the crank section are separated is restricted. Therefore, the contact of the piston and the cylinder head can be restricted, and maintenance of the compression section of the reciprocating compressor can be easily performed.

The reciprocating compressor which solves the above problem is provided with a crank section having a crankshaft, and a compression section having a cylinder, a cylinder head attached to the cylinder, a piston which reciprocates within the cylinder, and a piston rod which couples the crankshaft and the piston. The crank section and the compression section are separably formed, and the compression section is provided with an attachment portion for mounting a stopper member which restricts the movement in the reciprocating direction of the piston within the cylinder so that the piston does not come in contact with the cylinder head in case of being separated from the crank section.

According to the reciprocating compressor, by attaching the stopper member to the attachment portion before separating the compression section and the crank section, the reciprocation of the piston within the cylinder in the case where the compression section and the crank section are separated is restricted. Therefore, the contact of the piston and the cylinder head can be restricted, and maintenance of the compression section of the reciprocating compressor can be easily performed.

In the reciprocating compressor which solves the above problem, the attachment portion is formed so as to be capable of attaching the stopper member when the piston is located at a bottom dead center.

The compressors which require the stopper member are generally large-scale. Moreover, the large-scale compressors are often installed so that the crank section is disposed in the lower part while the compression section is disposed in the upper part. Therefore, it is preferable that the position of the piston at the time of attachment of the stopper member is a position of the bottom dead center which is a stable position. Here, the bottom dead center refers to a position in a state that the piston comes closest to the cylinder head on the crank section side.

According to the reciprocating compressor, since the attachment portion is formed so as to be capable of attaching the stopper member when the piston is located at the bottom dead center, the stopper member is easy to attach.

In the reciprocating compressor which solves the above problem, the compression section has a wall body portion which includes the cylinder and constitutes a wall body, and the attachment portion has a first fixed portion formed on the wall body portion for fixing the stopper member to the wall body portion, and a second fixed portion formed on the piston rod for fixing the stopper member to the piston rod.

According to the reciprocating compressor, the stopper member is fixed to the first fixed portion and the second fixed portion, thereby the movement in the reciprocating direction of the piston within the cylinder is restricted, and therefore the contact of the piston and the cylinder head is restricted.

In the reciprocating compressor which solves the above problem, the first fixed portion is formed on a substantially plate-shaped boundary wall that is a boundary portion which the boundary with the crank section in the wall body portion, and the second fixed portion is formed on a portion extending to the crank section side from the boundary wall in the piston rod.

According to the reciprocating compressor, since the separating work of the compression section and the crank section and the fixing work of the stopper member to the attachment portion can be performed in the vicinity, work efficiency can be improved.

In the reciprocating compressor which solves the above problem, the attachment portion enables the stopper member, which restricts the piston located at the bottom dead center from approaching the cylinder head on the crank section side, to be attached to the cylinder head on the crank section side, and is formed on the cylinder head on the crank section side.

The large-scale compressors which require the stopper member are often installed so that the crank section is disposed in the lower part while the compression section is disposed in the upper part. According to the reciprocating compressor, by attaching the stopper member to the attachment portion formed on the cylinder head on the crank section side, the piston located at the bottom dead center is restricted from approaching the cylinder head on the crank section side. Therefore, the contact of the piston and the cylinder head on the crank section side is restricted.

The reciprocating compressor which solves the above problem is provided with a first spacer which is disposed between a suction section of the cylinder and a suction pipe and is detachable to the suction section and the suction pipe, and a second spacer which is disposed between a discharge section of the cylinder and a discharge pipe and is detachable to the discharge section and the discharge pipe.

According to the reciprocating compressor, by removing the first spacer from the suction section and the suction pipe, the suction pipe is prevented from interfering with the compression section when the compression section is separated from the crank section. Moreover, by removing the second spacer from the discharge section and the discharge pipe, the discharge pipe is prevented from interfering with the compression section when the compression section is separated from the crank section.

In the reciprocating compressor which solves the above problem, the compression section is further provided with a tubular adapter which is disposed between the cylinder and the crank section and temporarily stores leakage gas from the compression section. A first joining pipe which is disposed between the adapter and a supply pipe for delivering a purge gas to the adapter and is detachable to the adapter and the supply pipe, and a second joining pipe which is disposed between the adapter and an exhaust pipe for exhausting the purge gas and the leakage gas from the adapter and is detachable to the adapter and the exhaust pipe are provided therein.

According to the reciprocating compressor, by removing the first joining pipe from the adapter and the supply pipe, the supply pipe is prevented from interfering with the compression section when the compression section is separated from the crank section. Moreover, by removing the second joining pipe from the adapter and the exhaust pipe, the exhaust pipe is prevented from interfering with the compression section when the compression section is separated from the crank section.

A compression section unit which solves the above problem is provided with a compression section having a cylinder, a cylinder head attached to the cylinder, and a piston which reciprocates within the cylinder, and a stopper member which restricts the movement in the reciprocating direction of the piston with respect to the cylinder so that the piston does not come in contact with the cylinder head. The stopper member is detachably attached to the compression section.

According to the compression section unit, the movement in the reciprocating direction of the piston with respect to the cylinder is restricted by the stopper member, and therefore the contact of the piston and the cylinder head can be restricted when the compression section unit is conveyed. Therefore, maintenance of the compression section of the reciprocating compressor can be easily performed.

A maintenance method of a reciprocating compressor which solves the above problem relates to a reciprocating compressor provided with a compression section which compresses gas, and a crank section which has a crankshaft and drives the compression section. The compression section is provided with a wall body portion which includes a cylinder and constitutes a wall body of the compression section, a cylinder head attached to the cylinder, a piston which reciprocates within the cylinder, a piston rod which couples the crankshaft and the piston, and at least one sealing member fixed to the wall body portion and disposed in the circumference of the piston rod. The method includes a release step of releasing the bonding of the compression section and the crank section in the reciprocating compressor, a separation step of separating the compression section to the crank section from a boundary portion of the wall body portion which forms the boundary with the crank section in the crank section side with respect to the at least one sealing member, and an assembly step of assembling another compression section in place of the separated compression section to the crank section after the separation step.

According to the maintenance method of the reciprocating compressor, compared to the case where the sealing member is located on the crank section side with respect to a division surface between the compression section and the crank section, the piston rod is prevented from interfering with the sealing member in the separation step or the assembly step. Therefore, maintenance of the compression section of the reciprocating compressor can be easily performed.

In the maintenance method of the reciprocating compressor which solves the above problem, the compression section is provided with an attachment portion for mounting a stopper member which restricts the movement in the reciprocating direction of the piston within the cylinder so that the piston does not come in contact with the cylinder head in case of being separated from the crank section. The method includes, before the release step, the separation step, and the assembly step, a preparation step of making prior arrangement so as to be able to perform a maintenance work and previously preparing the stopper member, and an attachment step of attaching the stopper member to the attachment portion with respect to the reciprocating compressor.

According to the maintenance method of the reciprocating compressor, by performing the separation step after the attachment step, the movement in the reciprocating direction of the piston within the cylinder in the separation step is restricted, and the contact of the piston and the cylinder head is restricted. Thereby, reuse of the compression section can be facilitated.

A maintenance method of a reciprocating compressor which solves the above problem relates to a reciprocating compressor provided with a crank section having a crankshaft, and a compression section having a cylinder, a cylinder head, and a piston which reciprocates within the cylinder. The crank section and the compression section are separably formed, and the compression section is provided with an attachment portion for mounting a stopper member which restricts the movement in the reciprocating direction of the piston within the cylinder so that the piston does not come in contact with the cylinder head in case of being separated from the crank section. The method includes a preparation step of making prior arrangement so as to be able to perform a maintenance work and previously preparing the stopper member, an attachment step of attaching the stopper member to the attachment portion with respect to the reciprocating compressor, a release step of releasing the bonding of the compression section and the crank section in the reciprocating compressor, a separation step of separating the compression section from the crank section after the attachment step and the release step, and an assembly step of assembling another compression section in place of the separated compression section to the crank section after the separation step.

According to the maintenance method of the reciprocating compressor, by performing the separation step after the attachment step, the movement in the reciprocating direction of the piston within the cylinder in the separation step is restricted, and the contact of the piston and the cylinder head is restricted. Thereby, reuse of the compression section can be facilitated.

In the maintenance method of the reciprocating compressor which solves the above problem, the attachment step is performed in a state that the piston is allowed to be located at a bottom dead center.

According to the maintenance method of the reciprocating compressor, for example, in the case of the reciprocating compressor installed so that the compression section is disposed in the upper part and the crank section is disposed in the lower part, the movement of the piston due to its own weight can be prevented when the piston is allowed to be located at the bottom dead center, and therefore it is possible to stabilize the piston at a certain position (in this case, at the bottom dead center position). Thereby, the fixing work of the stopper member can be easily performed.

In the maintenance method of the reciprocating compressor which solves the above problem, the reciprocating compressor is provided with a first spacer which is disposed between a suction section of the cylinder and a suction pipe and is detachable to the suction section and the suction pipe, and a second spacer which is disposed between a discharge section of the cylinder and a discharge pipe and is detachable to the discharge section and the discharge pipe. In the release step or the separation step, the first spacer and the second spacer are removed from the cylinder, the suction pipe, and the discharge pipe.

According to the maintenance method of the reciprocating compressor, the suction pipe and the discharge pipe are prevented from interfering with the compression section. Therefore, maintenance of the compression section of the reciprocating compressor can be easily performed.

In the maintenance method of the reciprocating compressor which solves the above problem, the reciprocating compressor is provided with a tubular adapter which is disposed between the cylinder and the crank section and temporarily stores leakage gas from the compression section. In the release step or the separation step, a first joining pipe which is disposed between the adapter and a supply pipe for delivering a purge gas to the adapter and is detachable to the adapter and the supply pipe, and a second joining pipe which is disposed between the adapter and an exhaust pipe for exhausting the purge gas and the leakage gas from the adapter and is detachable to the adapter and the exhaust pipe are removed.

According to the maintenance method of the reciprocating compressor, the suction pipe and the exhaust pipe are prevented from interfering with the compression section. Therefore, maintenance of the compression section of the reciprocating compressor can be easily performed.

According to the reciprocating compressor, the maintenance method of the reciprocating compressor, and the compression section unit, maintenance of the compression section can be easily performed.

DESCRIPTION OF THE PREFERRED EMBODIMENTS

First Embodiment

Figure 1:
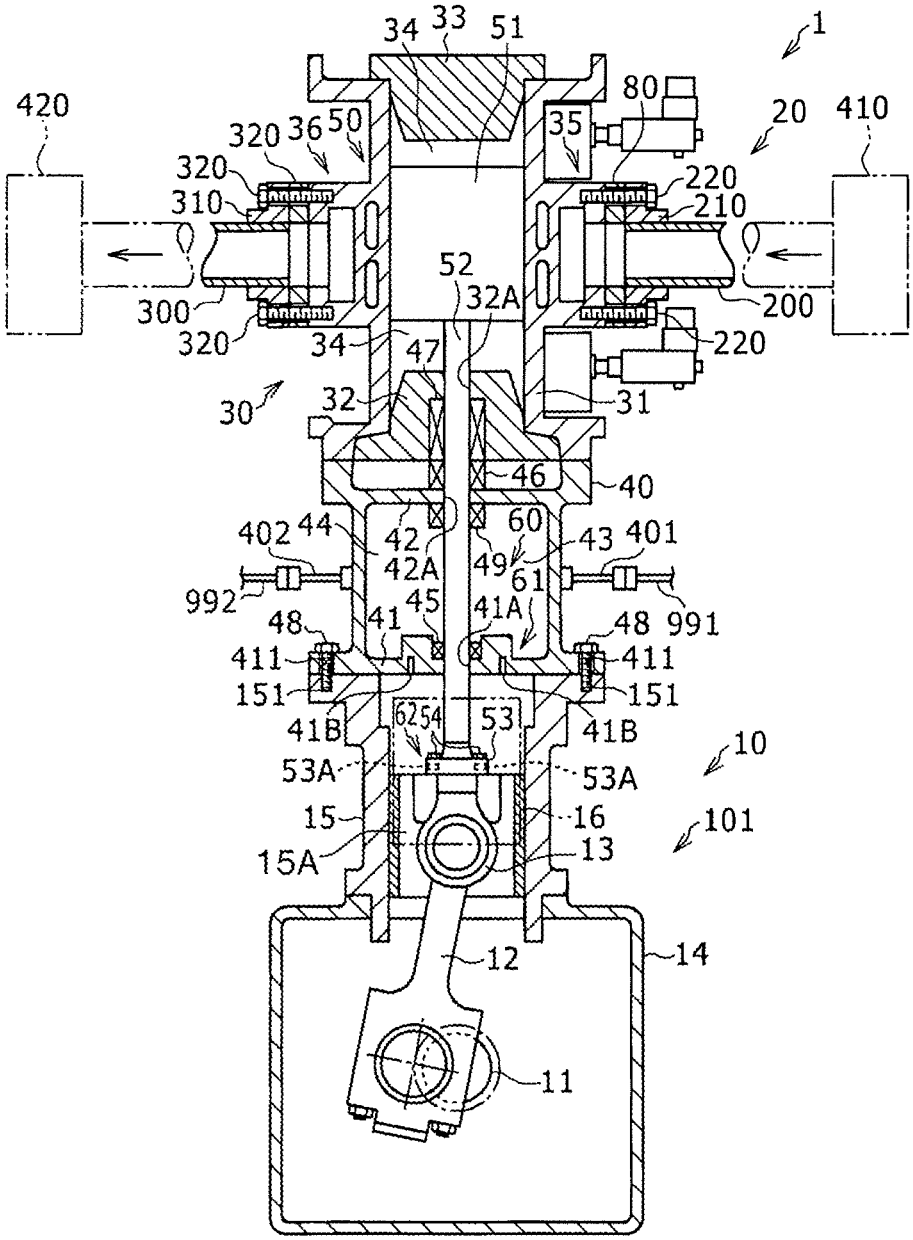
FIG. 1 is a partial cross-sectional view of a reciprocating compressor according to a first embodiment.

A reciprocating compressor 1 shown in FIG. 1 is a large-scale reciprocating compressor for compressing a boil-off gas (so-called BOG) generated in a storage tank of a liquefied natural gas, and is mounted on a ship, for example. In the ship, such a large-scale reciprocating compressor compresses and supplies the boil-off gas generated within the storage tank to the engine of the ship.

The reciprocating compressor 1 is provided with a compression section 20 which compresses gas, and a crank section 10 which drives the compression section 20. The reciprocating compressor 1 is a vertical machine, thus the compression section 20 is disposed on the upper side in the gravity direction than the crank section 10.

The crank section 10 is fixed to an attachment base (not shown), and has a crankshaft 11, a connecting rod 12 which converts a rotational motion of the crankshaft 11 into a reciprocating linear motion, and a crosshead 13 coupled to the connecting rod 12. Moreover, the crank section 10 has a crank casing 101 which accommodates the crankshaft 11 and the crosshead 13. Hereinafter, of the crank casing 101, a portion which accommodates the crankshaft 11 is referred to as a shaft case 14. A portion which is bonded to the shaft case 14 and accommodates the crosshead 13 is referred to as a head case 15. The shaft case 14 has a slide hole portion through which the crosshead 13 coupled to the connecting rod 12 performs a reciprocating linear motion.

To the side surface of the head case 15, a door 15A for work 16 by which a worker enters the interior of the head case 15 during a maintenance work is attached. It should be noted that, in FIG. 1, the door for work 16 is shown by a chain double-dashed line that is a phantom line for the sake of simplicity of illustration.

The compression section 20 is divided roughly into a stationary part 30 consisting of stationary bodies which are not moved during driving and a drive part 50 which is moved during driving.

That is, in the stationary part 30, the stationary bodies such as a cylinder 31, a cylinder head 32 on the crank section 10 side which is attached to an opening on the crank section 10 side of the cylinder 31, a cylinder head 33 which is attached to an opening on the opposite side to the crank section 10 of the cylinder 31, and sealing members 45, 46, 47, and 49 which are disposed in the circumference of a piston rod 52 are included. A center axis of the cylinder 31 corresponds to the gravity direction. Moreover, in the stationary part 30, a tubular adapter 40 which is disposed between the cylinder 31 and the crank section 10 is also included. Here, a wall body portion in the compression section 20 shall be a generic term for the cylinder 31 and the adapter 40, that is, all portions constituting a wall body of the stationary part 30 in the compression section 20. The sealing members 45, 49 are fixed to the adapter 40. The sealing members 46, 47 are fixed to the cylinder head 32. The sealing members 45, 46, 47, and 49 may fulfill a variety of sealing functions of prevention of a leak gas from the cylinder 31, interruption of a flow of oil toward the cylinder 31 from the crank section 10, prevention of the entry of dust into the cylinder 31, and the like.

In the interior of the adapter 40, a space 44 for temporarily storing the leak gas from the interior of the cylinder 31 is formed. The adapter 40 is connected to a supply pipe 991 via a first joining pipe 401. The first joining pipe 401 is detachable to the adapter 40 and the supply pipe 991. Moreover, the adapter 40 is connected to an exhaust pipe 992 via a second joining pipe 402. The second joining pipe 402 is detachable to the adapter 40 and the exhaust pipe 992. In the adapter 40, a purge gas (for example, nitrogen gas) is delivered from the supply pipe 991, and the purge gas and the leak gas are exhausted via the exhaust pipe 992.

On the other hand, in the drive part 50, members with movement such as a piston 51 which reciprocates within the cylinder 31, and a piston rod 52 which couples the piston 51 and the crankshaft 11 via the connecting rod 12 and the crosshead 13 are included. It should be noted that the reciprocating direction of the piston 1 corresponds to the gravity direction.

In the compression section 20, to a suction section 35 of the cylinder 31, a suction pipe 200 which allows the boil-off gas to be sucked into a compression chamber 34 of the cylinder 31 is coupled. To the suction pipe 200, a flange 210 for pipe connection is attached at the end thereof. Between the flange 210 and the suction section 35, a suction side spacer 80 as a first pacer is disposed, and the suction side spacer 80, the cylinder 31 and the flange 210 are detachably fixed by bolts 220.

Moreover, to a discharge section 36 of the cylinder 31, a discharge pipe 300 which discharges the boil-off gas compressed by the drive part 50 is coupled. To the discharge pipe 300, a flange 310 for pipe connection is attached at the end thereof. Between the flange 310 and the discharge section 36, a discharge side spacer 90 as a second spacer is provided, and the discharge side spacer 90, the cylinder 31 and the flange 310 are detachably fixed by bolts 320.

The suction pipe 200 is connected to a suction side buffer tank 410, and the discharge pipe 300 is connected to a discharge side buffer tank 420. The suction side buffer tank 410 and the discharge side buffer tank 420 suppress pulsation of the boil-off gas generated in association with the reciprocating linear motion of the drive part 50.

The adapter 40 has a substantially plate-shaped first boundary wall 41 which spreads in the vertical direction around the center axis of the piston rod 52, a second boundary wall 42 in contact with the cylinder head 32, and an substantially cylindrical outer circumferential wall 43 which joins the first boundary wall 41 and the second boundary wall 42. The first boundary wall 41 is a boundary portion which forms the boundary with the crank section 10. The first boundary wall 41 is located on the crank section 10 side with respect to the sealing members 45, 46, 47, and 49.

In the center of the first boundary wall 41, a through hole 41A which allows the piston rod 52 to pass through is formed. To the space 44 side of the through hole 41A, the sealing member 45 is attached. In the end of the first boundary wall 41, hole portions 411 extending toward the head case 15 are provided. The hole portions 411 are through holes. In the head case 15, bolt holes 151 are provided at positions corresponding to the hole portions 411. Into the hole portions 411 and the bolt holes 151, bolts 48 are inserted from the first boundary wall 41 side. In the compression section 20, by the bolts 48 and the bolt holes 151, a fastening portion for separably fastening the adapter 40 and the crank section 10 is formed. Moreover, heads of the bolts 48 are exposed to the exterior (that is, the space other than the interior space of the adapter 40 and the head case 15), and works of fastening and release of the bolts 48 are easily performed.

In the reciprocating compressor 1, the first boundary wall 41 acts as a division surface when the crank section 10 and the compression section 20 are separated.

In the center of the second boundary wall 42, a through hole 42A which allows the piston rod 52 to pass through is formed. To the upper side of the through hole 42A, the sealing member 46 is attached. In the interior of the cylinder head 32 on the upper side of the sealing member 46, a through hole 32A which allows the piston rod 52 to pass through is formed, and the sealing member 47 is attached to the through hole 32A.

In the piston rod 52, at the end of the portion extending to the crank section 10 side from the first boundary wall 41, a flange 53 is formed. Then, the flange 53 is fixed to the crosshead 13 by bolts 54, and thereby the piston rod 52 and the crosshead 13 are coupled.

As for the reciprocating compressor 1 configured as above, a maintenance work for replacing components such as the piston 51 and the cylinder 31 in which severe wear occurs is regularly performed. In the maintenance work, when the ship on which the reciprocating compressor 1 is mounted docks, the crank section 10 and the compression section 20 are separated and a new compression section 20 is assembled to the crank section 10.

Moreover, in the maintenance work, a stopper member 70 (see FIG. 3) which restricts the movement in the reciprocating direction of the piston 51 within the cylinder 31 so that the piston 51 does not come in contact with the cylinder heads 32, 33 in the case where the compression section 20 and the crank section 10 are separated is attached to an attachment portion 60 formed in the compression section 20.

In the reciprocating compressor 1 of the present embodiment, the attachment portion 60 consists of a first fixed portion 61 and a second fixed portion 62. The first fixed portion 61 is composed of the first boundary wall 41 constituting the wall body portion of the compression section 20, and a plurality of screw holes 41B which are formed in the first boundary wall 41 for fixing the front end of the stopper member 70. Moreover, the second fixed portion 62 is composed of the flange 53 at the lower end (that is, the end on the crank section 10 side) of the piston rod 52, and a plurality of screw holes 53A which are formed in the side surface of the flange 53 for fixing the lower end of the stopper member 70.

With reference to FIG. 2 to FIG. 5, a maintenance method of the reciprocating compressor 1 according to the present embodiment will be described with the action thereof.

The maintenance method of the reciprocating compressor 1 is performed in order of a preparation step, an attachment step, a release step, a separation step, and an assembly step.

The preparation step is a step of making prior arrangement so as to be able to perform maintenance of the reciprocating compressor 1 used and previously preparing the stopper member 70 which will be required for subsequent steps and a compression unit as a new compression section 20 for replacement.

As the prior arrangement of the reciprocating compressor 1, the operation is stopped and a shut-off valve (not shown) interposed between the suction pipe 200 and the discharge pipe 300 is closed.

Figure 2:
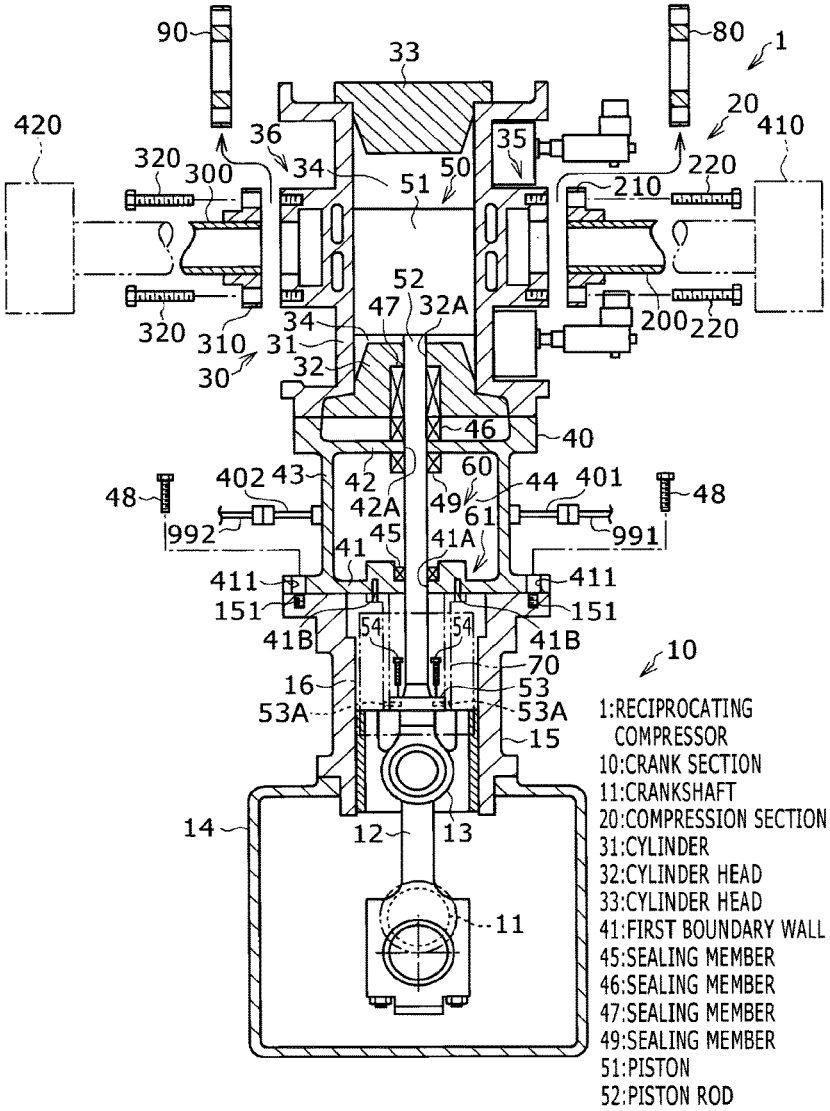
FIG. 2 is an explanatory diagram of a release step in a maintenance work of the reciprocating compressor.
Figure 4:
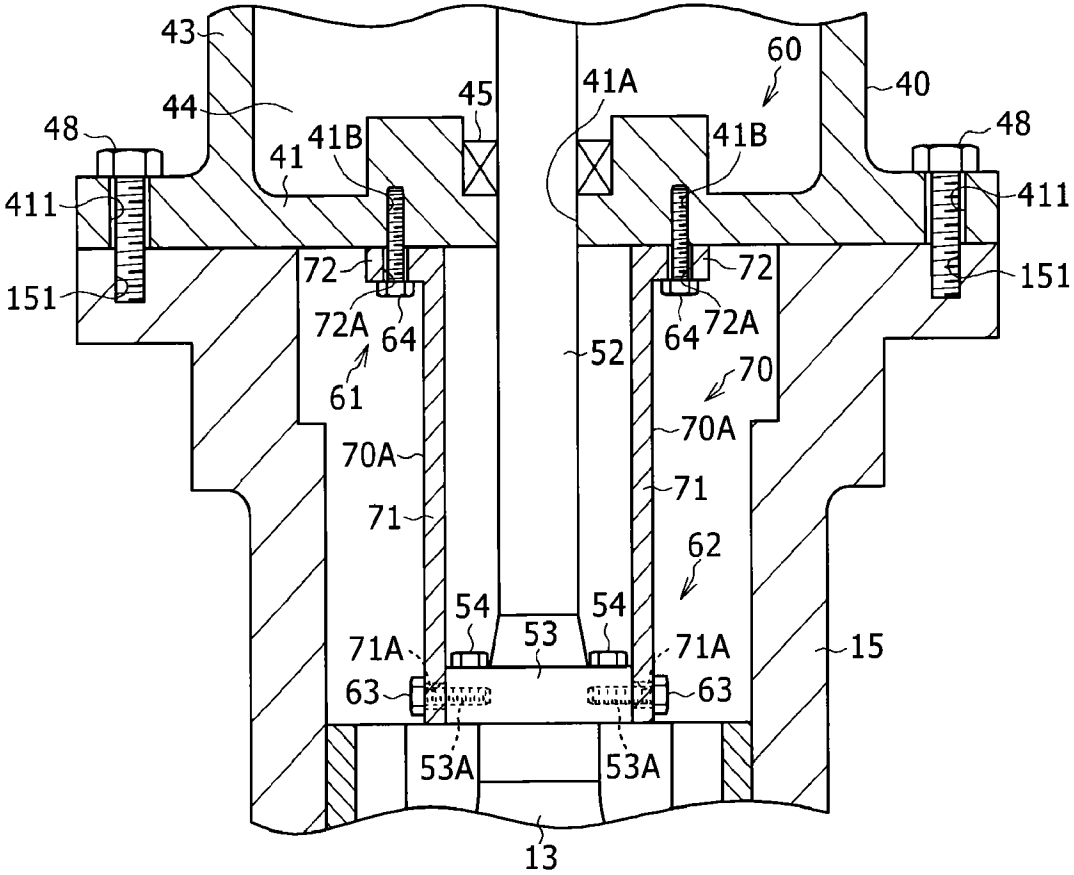
FIG. 4 is a cross-sectional view of a state that the stopper member is attached to an attachment portion.

As shown in FIG. 2 and FIG. 4, the attachment step is a step of attaching the stopper member 70. In addition, the attachment of the stopper member 70 is performed after rotating the crankshaft 11 and moving the piston 51 to a position of the bottom dead center. Here, the bottom dead center of the piston 51 refers to a position in a state that the piston 51 comes closest to the cylinder head 32 during normal operation of the reciprocating compressor 1. Moreover, the attachment of the stopper member 70 is performed by fixing the stopper member 70 to the first fixed portion 61 and the second fixed portion 62. It should be noted that the attachment position of the stopper member 70 is shown by a chain double-dashed line in FIG. 2.

Figure 3A:
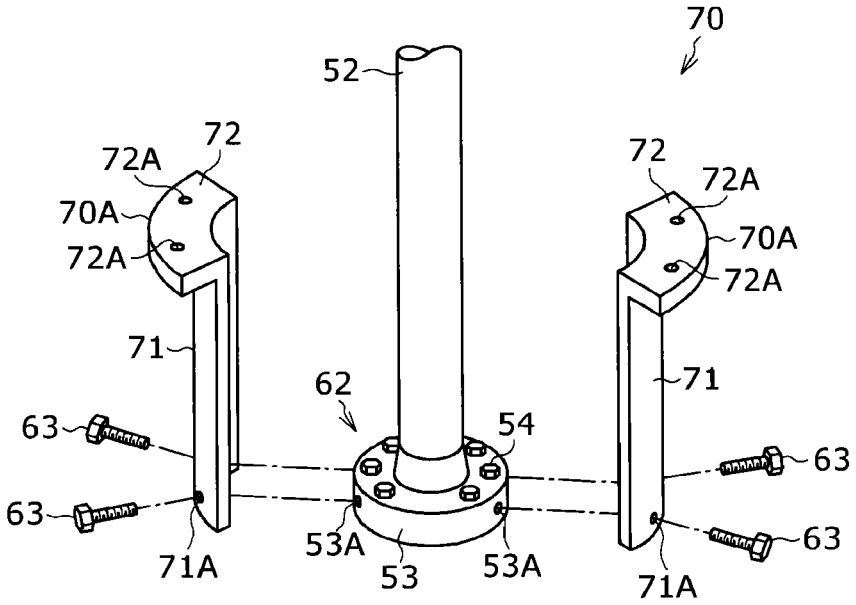
FIGS. 3A and 3B are explanatory diagrams of a stopper member used for maintenance of the reciprocating compressor, FIG. 3(*a*) is an exploded perspective view of the stopper member, and FIG. 3(*b*) is a perspective view of a state that the stopper member is fixed to a first fixed portion.
Figure 3B:
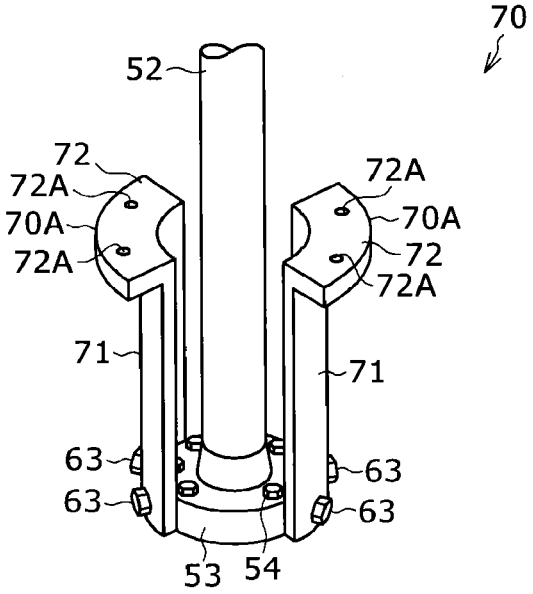

As shown in FIGS. 3(*a*) and 3(*b*), the stopper member 70 is configured so as to be dividedly disposed in the circumference of the piston rod 52. In the present embodiment, the stopper member 70 is shown to be divided into two parts as an example. Dividing members 70A constituting the stopper member 70 are of the same shape and configuration, and have a trunk portion 71 extending in the reciprocating direction of the piston rod 52, and a flange 72 formed at one end of the trunk portion 71. Moreover, as shown in FIG. 3(*b*), the stopper member 70 is configured so as to open a part of the circumference of the piston rod 52 toward the outside of the stopper member 70 in a state that the dividing members 70A are disposed in the circumference of the piston rod 52.

Of the trunk portion 71, in the end opposite to the flange 72, two through holes 71A are formed. Bolts 63 are inserted through the through holes 71A, and the bolts 63 are screwed into the screw holes 53A (see FIG. 4) of the flange 53 of the piston rod 52, thereby the stopper member 70 is fixed to the second fixed portion 62.

In the flange 72, two through holes 72A are formed. Bolts 64 (see FIG. 4) are inserted through the through holes 72A, and the bolts 64 are screwed into the screw holes 41B formed in the first boundary wall 41, thereby the stopper member 70 is fixed to the first fixed portion 61.

In this way, the stopper member 70 is fixed to the first fixed portion 61 and the second fixed portion 62, thereby the piston rod 52 is fixed to the wall body portion of the compression section 20 via the stopper member 70. Thereby, the movement in the reciprocating direction of the piston 51 within the cylinder 31 is restricted at the bottom dead center position.

As described above, an attachment work of the stopper member 70 is performed after moving the piston 51 to a position of the bottom dead center for the following reasons. For example, firstly, it is difficult to attach the stopper member 70 without stably maintaining the piston 51 at a certain position, and further, the piston 51 does not move to the lower side than the bottom dead center.

The release step is a step of releasing the bonding of the compression section 20 and the crank section 10.

As shown in FIG. 2, in the release step, the bolts 48 which couple the wall body portion of the compression section 20 and the wall body portion of the crank section 10 are removed from the hole portions 411. Since the heads of the bolts 48 are exposed to the exterior in a state of facing the upper side, a worker can easily perform a removal work of the bolts 48. Moreover, the bolts 54 which couple the piston rod 52 and the crosshead 13 are removed. Removal of the bolts 54 is performed by the worker who approached the flange 53 of the piston rod 52 from the opening portion (see FIG. 3(*b*)) of the stopper member 70.

The separation step is a step separating the compression section 20 from the crank section 10.

Firstly, the bolts 220 are pulled out of the flange 210, and the suction side spacer 80 is removed from the suction section 35 and the suction pipe 200. The bolts 320 are pulled out of the flange 310, and the discharge side spacer 90 is removed from the discharge section 36 and the discharge pipe 300. Moreover, the first and second joining pipes 401, 402 which are disposed between the adapter 40 and the suction pipe 991 and exhaust pipe 992 are removed. It should be noted that a removal work of the spacers 80, 90 and a removal work of the first and second joining pipes 401, 402 may be performed simultaneously or one after another.

Figure 5:
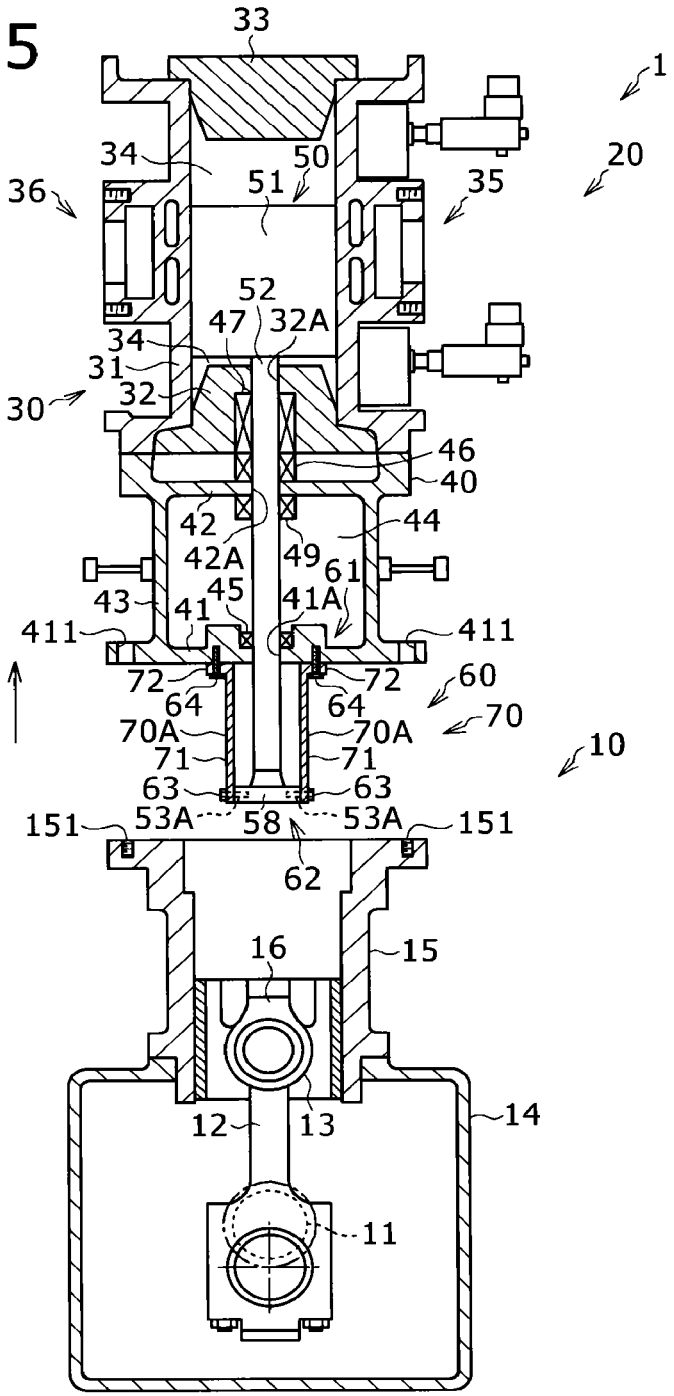
FIG. 5 is a state diagram of the reciprocating compressor during a separation step in the maintenance work of the reciprocating compressor.

As shown in FIG. 5, in the separation step, the compression section 20 is separated with respect to the crank section 10 from the first boundary wall 41 by being lifted up with the use of a crane. At this time, the piston rod 52 remains protruded downwardly from the first boundary wall 41 and is in a state of being fixed to the wall body portion of the compression section 20 by the stopper member 70.

In the separation step, since the piston rod 52 is fixed to the wall body portion of the compression section 20 by the stopper member 70 as described before, the piston 51 is restrained. Therefore, the movement in the reciprocating direction of the piston 51 within the cylinder 31 is restricted, and the contact of the piston 51 with the cylinder heads 32, 33 is avoided. Moreover, since the crank section 10 may remain fixed to the attachment base (not shown), a separation work of the compression section 20 can be performed easily and quickly.

The assembly step is a step of assembling a new compression section 20 previously prepared to the crank section 10 from which the compression section 20 was separated.

The new compression section 20 is conveyed to the site as the compression unit to which the stopper member 70 is previously attached to the attachment portion 60, and is lifted up by the crane and attached to the crank section 10. Then, after the new compression section 20 is attached to the crank section 10, the stopper member 70 is removed. Thus, the assembly step is completed. It should be noted that the compression section 20 separated in the separation step is repaired and reused.

According to the present embodiment, the following effects are obtained.

(1) If a sealing member is located on a crank section side with respect to a division surface of a compression section with respect to the crank section, a piston rod may interfere with the sealing member during a separation step. Moreover, it is necessary to insert the piston rod into the sealing member during an assembly step, and therefore the piston rod may interfere with the sealing member. In this regard, in the reciprocating compressor 1 of the present embodiment, the division surface (that is, the first boundary wall 41) is provided on the crank section 10 side with respect to all sealing members 45, 46, 47, and 49, and therefore the piston rod 52 is prevented from interfering with the sealing members 45, 46, 47, and 49. Therefore, maintenance of the compression section 20 of the reciprocating compressor 1 can be easily performed.

(2) In a maintenance work of a reciprocating compressor, if a compression stage is intended to be separated from a crank section by releasing coupling of the compression stage and the crank section, a piston can move beyond a reciprocating range at the time of normal operation of the reciprocating compressor, and therefore the piston is likely to come in contact with a cylinder head. In this regard, in the reciprocating compressor 1 of the present embodiment, the stopper member 70 is attached to the attachment portion 60 in the attachment step, and therefore the reciprocation of the piston 51 within the cylinder 31 is restricted when the compression section 20 and the crank section 10 are separated in the separation step. Therefore, during the maintenance work of the reciprocating compressor 1, the contact of the piston 51 and the cylinder heads 32, 33 can be restricted. Further, the compression section 20 which is newly attached to the reciprocating compressor 1 is conveyed to the site in a state that the stopper member 70 is attached thereto, thereby the contact of the piston 51 and the cylinder heads 32, 33 during conveyance can be restricted.

(3) The attachment portion 60 of the reciprocating compressor 1 is formed so as to be able to attach the stopper member 70 when the piston 51 is located at the bottom dead center, and therefore the attachment step can be performed when the piston 51 is located at the bottom dead center. Therefore, the movement of the piston 51 due to its own weight in the attachment step can be prevented, and the piston 51 can be stabilized at a certain position, that is, the bottom dead center. Thereby, the fixing work of the stopper member 70 in the attachment step can be easily performed.

(4) Whereas the first fixed portion 61 is formed on the first boundary wall 41, the second fixed portion 62 is formed on the flange 53 of the portion extending to the crank section 10 side from the first boundary portion 41 in the piston rod 52. Therefore since the attachment step and the release step can be performed in the vicinity, work efficiency of the attachment step and the release step can be improved.

(5) If the compression unit is conveyed in the assembly step in a state that the stopper member 70 is attached thereto, the movement in the reciprocating direction of the piston 51 with respect to the cylinder 31 is restricted by the stopper member 70. Therefore, it is possible to restrict the contact of the piston 51 and the cylinder head 32 when the compression unit is conveyed.

(6) The contact of the piston 51 and the cylinder head 32 is restricted in the separation step, and therefore reuse of the compression section 20 can be facilitated.

(7) Since the screw holes 53A of the second fixed portion 62 are formed in the flange 53 of the piston rod 52, there is no need to provide the screw holes 53A in a shaft portion of the piston rod 52, and it possible to maintain durability of the piston rod 52.

(8) The spacers 80, 90 are provided between the cylinder 31 and the suction pipe 200 and discharge pipe 300, and thereby the suction pipe 200 and the discharge pipe 300 are prevented from interfering with the compression section 20 when separating the compression section 20 from the crank section 10.

(9) The first and second joining pipes 401, 402 are provided between the adapter 40 and the supply pipe 991 and exhaust pipe 992, and thereby the supply pipe 991 and the exhaust pipe 992 are prevented from interfering with the compression section 20 in the separation step.

Second Embodiment

Next, a second embodiment will be described.

In the reciprocating compressor 1 according to the second embodiment, the stopper member 70 of the first embodiment is changed. Moreover, there is a difference in that the second fixed portion 62 is changed in association with the change of the stopper member 70. Hereinafter, the differences with the first embodiment will be mainly described, and the same numerals as the first embodiment will be given to the same components as the first embodiment and the description thereof will be omitted.

Figure 6:
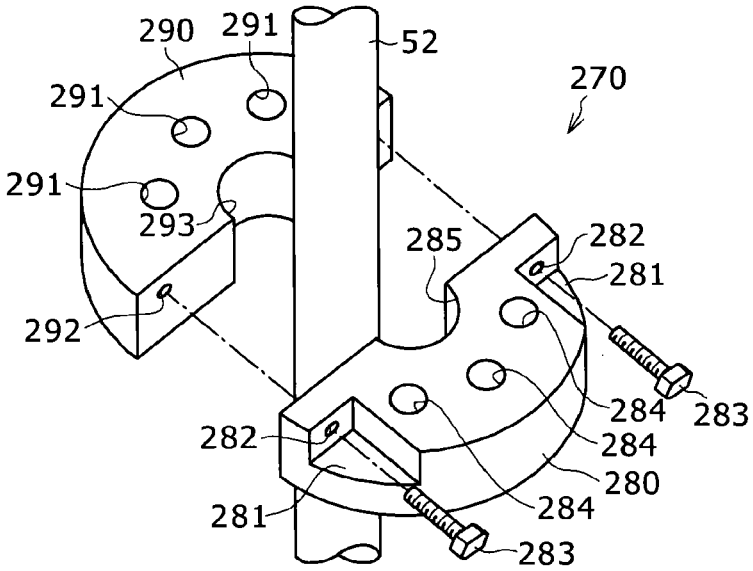
FIG. 6 is an exploded perspective view of a stopper member used for maintenance of a reciprocating compressor according to a second embodiment.

As shown in FIG. 6, a stopper member 270 of the present embodiment has a pair of semicircular plate-shaped first fixing member 280 and second fixing member 290.

In the first fixing member 280, stepped portions 281 are formed at both ends of the circumferential direction, and through holes 282 through which bolts 283 are inserted are formed in the stepped portions 281. Moreover, in a plate-shaped portion of the first fixing member 280, a plurality of through holes 284 passing it are formed. Further, in the center of the inner circumferential surface in the radial direction of the first fixing member 280, a halved hole portion 285 to be frictionally engaged with the outer circumferential surface at the intermediate height position of the piston rod 52 is formed.

In the second fixing member 290, screw holes 292 into which the bolts 283 are screwed are formed in both ends of the circumferential direction. Moreover, in a plate-shaped portion of the second fixing member 290, a plurality of through holes 291 passing it are formed. Further, in the center of the inner circumferential surface in the radial direction of the second fixing member 290, a halved hole portion 293 to be frictionally engaged with the outer circumferential surface at the intermediate height position of the piston rod 52 is formed.

Figure 7:
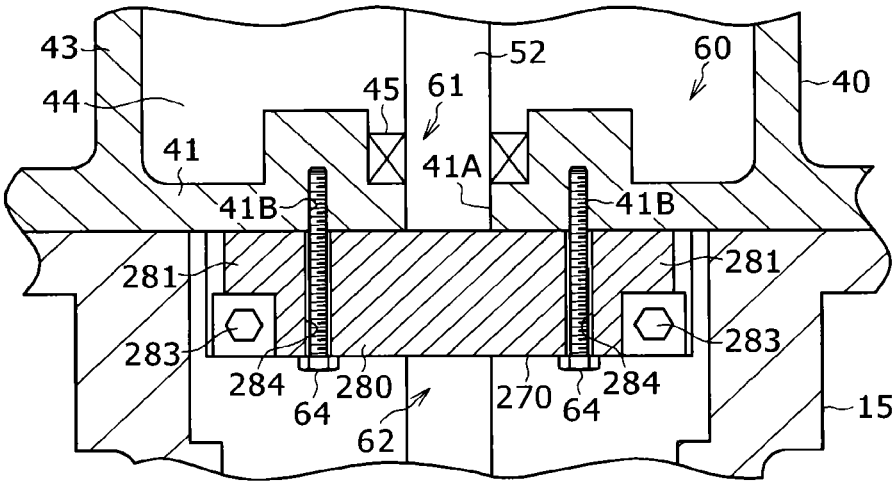
FIG. 7 is a cross-sectional view of a state that the stopper member is attached to an attachment portion.

With reference to FIG. 6 and FIG. 7, the attachment step of the stopper member 270 will be described with the action of the reciprocating compressor 1 according to the present embodiment.

In the attachment step, the stopper member 270 is attached to a portion protruding from the first boundary wall 41 of the outer circumferential surface of the piston rod 52, and the bolts 283 are screwed into the screw holes 292, thereby sandwiching the outer circumferential surface of the piston rod 52 by the halved hole portion 285 and the halved hole portion 293. Therefore, a position of the piston rod 52 with respect to the stopper member 270 is fixed by friction of the halved hole portion 285 and halved hole portion 293 and the outer circumferential surface of the piston rod 52. Thus, the second fixed portion 62 of the present embodiment refers to a portion in the vicinity of the first boundary wall 41 of the portion the piston rod 52 protrudes from the first boundary portion 41.

Next, in the first fixing member 280 and the second fixing member 290, the plurality of bolts 64 are inserted through the through holes 284 and the through holes 291 as in the case of the first embodiment, and the bolts 64 are screwed into the screw holes 41B of the first fixed portion 61 respectively, thereby the stopper member 270 is fixed to the first fixed portion 61.

In this way, the stopper member 270 is fixed to the first fixed portion 61 and the second fixed portion 62, thereby the reciprocation of the piston 51 within the cylinder 31 is restricted in the case where the compression section 20 and the crank section 10 are separated in the separation step. Therefore, the contact of the piston 51 and the cylinder heads 32, 33 can be restricted during the maintenance work of the reciprocating compressor 1.

The reciprocating compressor 1 according to the second embodiment configured as above can exhibit the effects corresponding to the effects (1) to (6), (8), and (9) according to the first embodiment, and further can exhibit the following effect.

(10) As for the stopper member 270, attachment to the first fixed portion 61 and attachment to the second fixed portion 62 are performed in the vicinity of the first boundary wall 41, thereby improving workability.

Third Embodiment

Next, the reciprocating compressor 1 according to a third embodiment will be described.

Figure 8A:
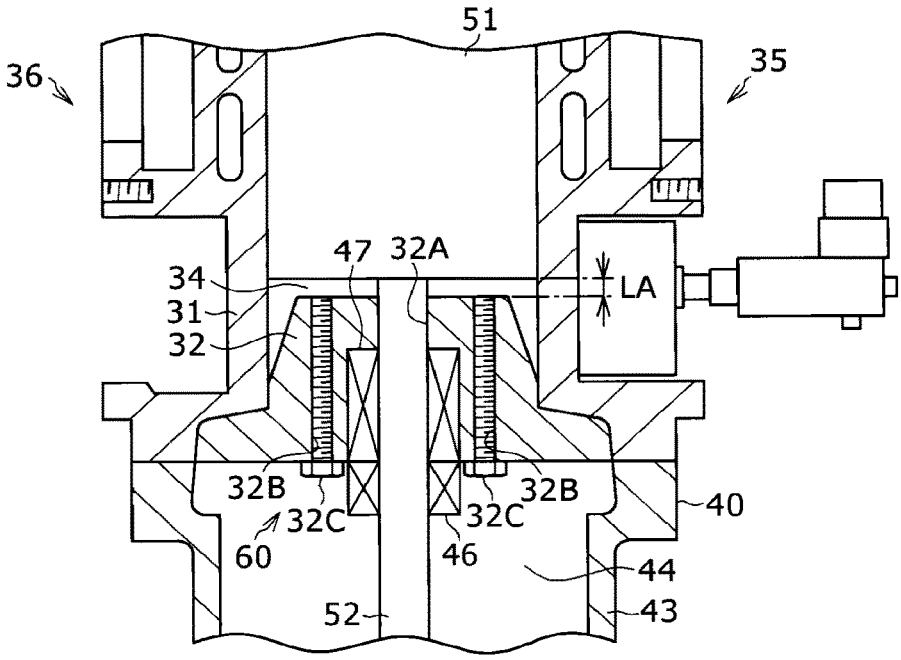
FIGS. 8A and 8B are explanatory diagrams of an attachment portion of a stopper member in a reciprocating compressor according to a third embodiment, FIG. 8(*a*) is a cross-sectional view of the surroundings of the attachment portion, and FIG. 8(*b*) is a perspective view of a cylinder head on a crank section side.
Figure 8B:
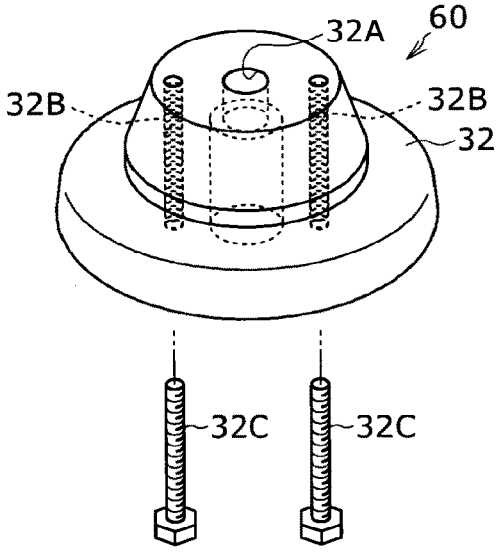

In the third embodiment, the attachment portion 60 and the stopper member 70 of the first embodiment are changed, and in association with the change, the cylinder head 32 on the crank section 10 side is changed. Moreover, as shown in FIG. 8(*a*), the reciprocating compressor 1 according to the present embodiment is applied to a mode of the case where the reciprocating compressor 1 according to the first embodiment does not have the second boundary wall 42 of the adapter 40. Hereinafter, the differences with the first embodiment will be mainly described, and the same numerals as the first embodiment given to the same components as the first embodiment and the description thereof will be omitted.

As shown in FIGS. 8(*a*) and 8(*b*) in the reciprocating compressor 1 according to the present embodiment, two screw holes 32B are formed so as to axially pass through the cylinder head 32 on the crank section 10 side at symmetric positions with respect to the center axis of the cylinder 31. Then, in the screw holes 32B, bolts 32C to which a sealing compound is applied are attached, and the screw holes 32B are sealed. The bolts 32C are formed to a length at which the front end of a threaded portion is flush with a surface on the piston 51 side of the cylinder head 32 in a state of being screwed into the screw holes 32B. Therefore, the bolts 32C do not become an obstacle in the normal operation.

The attachment portion 60 of the stopper member in the reciprocating compressor 1 according to the present embodiment is composed of the cylinder head 32 on the crank section 10 side, and the screw holes 32B provided in the cylinder head 32.

Figure 9:
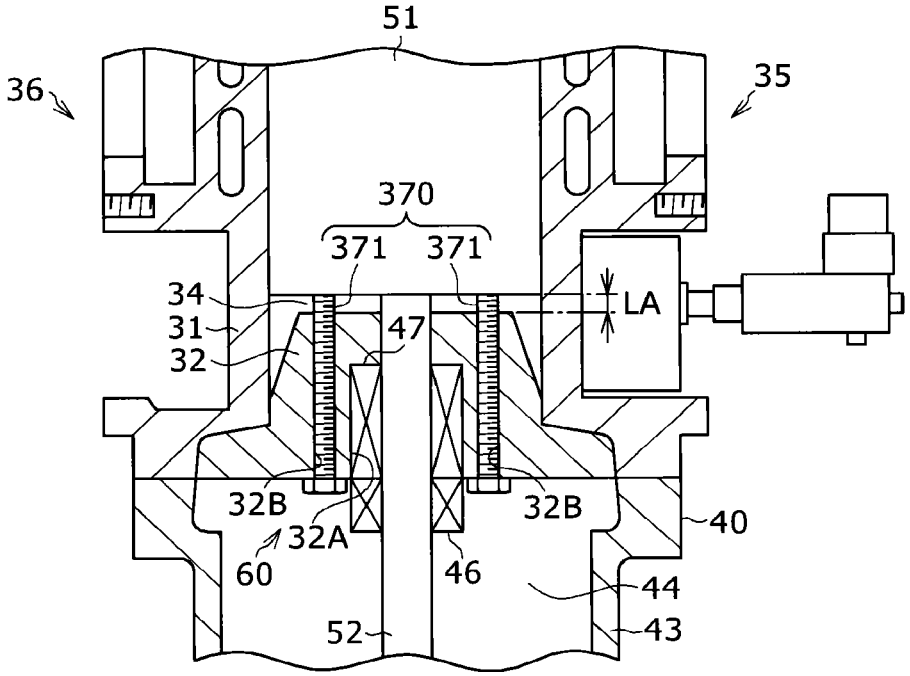
FIG. 9 is a cross-sectional view of a state that the stopper member used for maintenance of the reciprocating compressor is attached to the attachment portion.

Moreover, as shown in FIG. 9, a stopper member 370 used for the reciprocating compressor 1 according to the present embodiment is composed of two bolts 371 screwed into the two screw holes 32B of the cylinder head 32. The bolts 371 are set to a length it protrudes by a length LA in a state of being screwed into the screw holes 32B. The length LA corresponds to a gap between the piston 51 and the cylinder head 32 when the piston 51 is at the bottom dead center position.

In addition, since the worker needs to enter the interior of the adapter 40 in order to attach the stopper member 370, the door for work (not shown) for the worker's comings and goings is provided on the outer circumferential wall 43 of the adapter 40.

Next, the attachment step of the stopper member 370 will be described with the action of the reciprocating compressor 1 according to the present embodiment.

In the attachment step, firstly, the boil-off gas within the space 44 is exhausted to the exterior from the door for work (not shown) attached to the outer circumferential wall 43 of the adapter 40 and from other spots. Next, the worker removes the attached bolts 32C via the door for work of the adapter 40 during operation, and in place of the bolts 32C, screws the bolts 371 constituting the stopper member 370 into the screw holes 32B. Thereby, as shown in FIG. 9, the front end portions of the bolts 371 protrude from the cylinder head 32 by the length LA. Thus, the attachment step is completed.

The stopper member 370 can restrict the piston 51 from further moving to the crank section 10 side than the bottom dead center. In this manner, in the case of the reciprocating compressor 1 installed so that the crank section 10 is located on the lower side and the compression section 20 is located on the upper side, the compression section 20 can be separated from the crank section 10 while maintaining the orientation of the compression section 20 by the crane. Therefore, it is enough if the movement in the reciprocating direction of the piston 51 can be restricted by the stopper member 370 so that the piston 51 may not come in contact with at least the cylinder head 32 on the lower side in the gravity direction.

The reciprocating compressor 1 according to the third embodiment configured as above can exhibit the effects corresponding to the effects (1) to (3), (5), (6), (8), and (9) according to the first embodiment. It should be noted that it is preferable if the application of the reciprocating compressor 1 according to the present embodiment to the intended use where it is not always handled so that the cylinder head 32 on the crank section 10 side is on the lower side is restrained.

Modified Example

The description about the above embodiments is illustrative of possible modes of the reciprocating compressor, the compression unit, and the maintenance method of the reciprocating compressor according to the present invention, and is not intended to limit the modes. The reciprocating compressor, the compression unit, and the maintenance method of the reciprocating compressor according to the present invention may take, for example, modified examples of the above embodiments described below, and modes which at least two modified examples which are mutually-consistent are combined.

In the first embodiment and the second embodiment, although the first fixed portion 61 is formed on the first boundary wall 41, the position at which the first fixed portion 61 is formed is not limited thereto. The first fixed portion 61 may be formed, for example, at another position of the wall body portion included in the stationary part 30 as long as the attachment work of the stopper members 70, 270 is easy at the position. For example, the position may be the outer circumferential wall 43, a cylinder block forming the cylinder 31, or the like.

In the first embodiment, although two dividing members 70A constitute the stopper member 70 to be attached to the attachment portion 60 in the attachment step, the stopper member 70 may have one substantially cylindrical shape. Moreover, if the stopper member 70 is divided, the shape of the individual dividing member 70A is preferable to be the same, and further, the shape when the plurality of dividing members 70A are combined together is preferable to be the shape forming a substantially circular cylinder or a large part of a circular cylinder. It should be noted that the number of the dividing members 70A is not particularly concerned.

In the embodiments, although one reciprocating compressor 1 is fixed to the attachment base (not shown), a plurality of compression sections 20 may be provided on a common attachment base. The plurality of compression sections 20 are driven by a common crankshaft 11. Even in this case, the attachment way and the maintenance method of the respective compressors are similar to the foregoing.

In the embodiments, the adapter 40 of the reciprocating compressor 1 may be omitted. In this case, the sealing members 45, 49 are fixed to the cylinder 31. Moreover, other tubular member may be added to the adapter 40 and the cylinder 31 to form the wall body portion. It should be noted that the number of the sealing members to be fixed to the wall body portion is not particularly concerned.

In the embodiments, the first boundary wall 41 and the second boundary wall 42 may be formed of different members with respect to the outer circumferential wall 43 respectively.

In the first and second embodiments, the release step may be performed before the attachment step. Moreover, in the third embodiment, since the worker needs to perform a work while approaching the cylinder head 32 in the attachment step, it is preferable to perform the release step after the attachment step.

The removal work of the spacers 80, 90 and the removal work of the first and second joining pipes 401, 402 may be performed in the above release step.

In the third embodiment, the number of the bolts 371 constituting the stopper member 370 and the number of the screw holes 32B may be one or three or more. Moreover, in the third embodiment, the stopper member 370 may be another member other than the bolt as long as the member has a shape which restricts the contact of the piston 51 with the cylinder head 32.

In the embodiments, if the piston 51 can be stably fixed at a position other than the bottom dead center, the attachment step may be performed at a position other than the bottom dead center.

What is claimed is:

1. A reciprocating compressor comprising:

a compression section which compresses gas;

a crank section which is separate from the compression section and which has a crankshaft and a head case; and at least one first fastener for fastening the compression section to the crank section, wherein the compression section comprises:

a wall body portion which includes a cylinder;

a cylinder head attached to the cylinder;

a piston which reciprocates within the cylinder;

a piston rod coupled to the crankshaft by at least one second fastener provided within the head case, wherein the piston rod is also coupled to the piston to drive the piston when the crankshaft is rotated;

at least one sealing member fixed to the wall body portion and disposed at the circumference of the piston rod, wherein the wall body portion has a substantially plate-shaped boundary wall whose plate surfaces extend transverse to the length of the piston rod, one plate surface of the substantially plate-shaped boundary wall comprising boundary with the crank section when the compression section and the crank section are fastened by the at least one first fastener and further comprising a division surface when the crank section and the compression section are separated from one another, and the other plate surface of the substantially plate-shaped boundary wall being at the side of the boundary wall which is opposite to the crank section, the boundary wall being fixed to the crank section by the at least one first fastener directly fixing the boundary wall and the head case of the crank section, and a door in the head case at a location to expose the at least one second fastener such that a worker can access and remove the at least one second fastener via said door.

2. The reciprocating compressor according to claim 1, further comprising:

a first spacer which is disposed between a suction section of the cylinder and a suction pipe and is detachable to the suction section and the suction pipe; and a second spacer which is disposed between a discharge section of the cylinder and a discharge pipe and is detachable to the discharge section and the discharge pipe.

3. The reciprocating compressor according to claim 1, wherein the compression section further comprises a tubular adapter which is disposed between the cylinder and the crank section and temporarily stores leakage gas from the compression section, further comprising:

a first joining pipe which is disposed between the adapter and a supply pipe for delivering a purge gas to the adapter and is detachable to the adapter and the supply pipe; and a second joining pipe which is disposed between the adapter and an exhaust pipe for exhausting the purge gas and the leakage gas from the adapter and is detachable to the adapter and the exhaust pipe.

4. A reciprocating compressor comprising:

a compression section which compresses gas;

a crank section which is separate from the compression section and which has a crankshaft; and at least one fastener for fastening the compression section to the crank section, wherein the compression section comprises:

a wall body portion which includes a cylinder;

a cylinder head attached to the cylinder;

a piston which reciprocates within the cylinder;

a piston rod which couples the crankshaft and the piston to drive the piston when the crankshaft is rotated; and at least one sealing member fixed to the wall body portion and disposed at the circumference of the piston rod, wherein the wall body portion has a boundary portion which forms the boundary with the crank section when the compression section and the crank section are fastened by the at least one fastener, which boundary portion comprises a division surface when the crank section and the compression section are separated from one another, and wherein the at least one sealing member is located at the boundary portion at a side of the boundary portion which is opposite to the crank section, wherein the compression section comprises an attachment portion for mounting a stopper member which restricts the movement in the reciprocating direction of the piston within the cylinder so that the piston does not come in contact with the cylinder head in case of being separated from the crank section.

5. The reciprocating compressor according to claim 4, wherein the attachment portion is formed so as to be capable of attaching the stopper member when the piston is located at a bottom dead center.

6. The reciprocating compressor according to claim 5, wherein the attachment portion enables the stopper member, which restricts the piston located at the bottom dead center from approaching the cylinder on the crank section side, to be attached to the cylinder on the crank section side, and is formed on the cylinder on the crank section side.

7. The reciprocating compressor according to claim 4, wherein the attachment portion has a first fixed portion formed on the wall body portion for fixing the stopper member to the wall body portion, and a second fixed portion formed on the piston rod for fixing the stopper member to the piston rod.

8. The reciprocating compressor according to claim 7, wherein the boundary portion is a substantially plate-shaped boundary wall, the first fixed portion is fixed to the plate-shaped boundary wall, and the second fixed portion is formed on the piston rod at a portion extending toward the crank section from the boundary wall.

9. A reciprocating compressor comprising:

a crank section having a crankshaft; and a compression section having a cylinder, a cylinder head attached to the cylinder, a piston which reciprocates within the cylinder, and a piston rod which couples the crankshaft and the piston, wherein the crank section and the compression section are separably formed, and wherein the compression section comprises an attachment portion for mounting a stopper member which restricts the movement in the reciprocating direction of the piston within the cylinder so that the piston does not come in contact with the cylinder head in case of being separated from the crank section.

10. The reciprocating compressor according to claim 9, wherein the attachment portion is formed so as to be capable of attaching the stopper member when the piston is located at a bottom dead center.

11. The reciprocating compressor according to claim 9, wherein the compression section has a wall body portion which includes the cylinder, and wherein the attachment portion has a first fixed portion formed on the wall body portion for fixing the stopper member to the wall body portion, and a second fixed portion formed on the piston rod for fixing the stopper member to the piston rod.

12. The reciprocating compressor according to claim 9, further comprising:

a first spacer which is disposed between a suction section of the cylinder and a suction pipe and is detachable to the suction section and the suction pipe; and a second spacer which is disposed between a discharge section of the cylinder and a discharge pipe and is detachable to the discharge section and the discharge pipe.

13. The reciprocating compressor according to claim 9, wherein the compression section further comprises a tubular adapter which is disposed between the cylinder and the crank section and temporarily stores leakage gas from the compression section, further comprising:

a first joining pipe which is disposed between the adapter and a supply pipe for delivering a purge gas to the adapter and is detachable to the adapter and the supply pipe; and a second joining pipe which is disposed between the adapter and an exhaust pipe for exhausting the purge gas and the leakage gas from the adapter and is detachable to the adapter and the exhaust pipe.

14. A compression section unit comprising;

a compression section having a cylinder, a cylinder head attached to the cylinder, and a piston which reciprocates within the cylinder; and a stopper member which is detachably attached to the compression section and restricts the movement in the reciprocating direction of the piston with respect to the cylinder so that the piston does not come in contact with the cylinder head.

* * * * *